US011849277B2

(12) United States Patent
Shen et al.

(10) Patent No.: US 11,849,277 B2
(45) Date of Patent: Dec. 19, 2023

(54) LOUDSPEAKER SYSTEM

(71) Applicant: SUZHOU SONAVOX ELECTRONICS CO., LTD., Suzhou (CN)

(72) Inventors: Yuewu Shen, Suzhou (CN); Shenggang Tao, Suzhou (CN); Jianfeng Tang, Suzhou (CN); Xiaoqing Wang, Suzhou (CN); Guoqiang Chai, Suzhou (CN)

(73) Assignee: SUZHOU SONAVOX ELECTRONICS CO., LTD., Suzhou (CN)

( * ) Notice: Subject to any disclaimer, the term of this patent is extended or adjusted under 35 U.S.C. 154(b) by 281 days.

(21) Appl. No.: 17/432,104

(22) PCT Filed: Oct. 15, 2019

(86) PCT No.: PCT/CN2019/111157

§ 371 (c)(1),
(2) Date: Aug. 19, 2021

(87) PCT Pub. No.: WO2020/168729

PCT Pub. Date: Aug. 27, 2020

(65) Prior Publication Data

US 2023/0138715 A1 May 4, 2023

(30) Foreign Application Priority Data

Feb. 19, 2019 (CN) ..... 201910121296.5

(51) Int. Cl.
*H04R 1/28* (2006.01)
*H04R 7/18* (2006.01)
(Continued)

(52) U.S. Cl.
CPC ..... *H04R 1/2803* (2013.01); *H04R 1/025* (2013.01); *H04R 1/2826* (2013.01); *H04R 1/403* (2013.01);
(Continued)

(58) Field of Classification Search
CPC ..... H04R 1/025; H04R 1/227; H04R 1/2803; H04R 1/2819; H04R 1/2826;
(Continued)

(56) References Cited

U.S. PATENT DOCUMENTS 3,275,758 A * 9/1966 Bryan ..... H04R 1/2834 381/186
4,326,099 A * 4/1982 Maille ..... H04R 5/02 381/89
(Continued)

FOREIGN PATENT DOCUMENTS

CN 201528419 U 7/2010
CN 203057482 U 7/2013
(Continued)

*Primary Examiner* — Huyen D Le
(74) *Attorney, Agent, or Firm* — SOROKER AGMON NORDMAN PTE LTD

(57) ABSTRACT

A loudspeaker system, having a good low-frequency response without a large box and effectively improving the efficiency of the loudspeaker system, so as to increase the output sound pressure level of the system, comprises a box and a plurality of loudspeakers arranged in the box and connected in parallel with each other, wherein each of the loudspeakers comprises a frame, a diaphragm arranged on the frame, and a voice coil for driving a vibration of the diaphragm; front surfaces of the diaphragms of the loudspeakers are arranged to face each other; a sound cavity is formed among the front surfaces of the diaphragms, and the sound cavity is in communication with the outside of the box; and each of the frames is located between a rear surface of its corresponding diaphragm and an inner wall of the box.

11 Claims, 3 Drawing Sheets

(51) Int. Cl.
*H04R 1/02* (2006.01)
*H04R 1/40* (2006.01)

(52) U.S. Cl.
CPC ..... *H04R 7/18* (2013.01); *H04R 2209/026* (2013.01); *H04R 2400/11* (2013.01)

(58) Field of Classification Search
CPC ..... H04R 1/2857; H04R 1/403; H04R 3/04; H04R 7/18; H04R 2209/026; H04R 2400/11
See application file for complete search history.

(56) References Cited

U.S. PATENT DOCUMENTS

| | | | | | |
|---|---|---|---|---|---|
| 4,733,749 | A | * | 3/1988 | Newman | H04R 1/2865 181/150 |
| 5,253,301 | A | * | 10/1993 | Sakamoto | H04R 1/2826 381/89 |
| 5,388,162 | A | * | 2/1995 | Sohn | H04R 1/227 181/146 |
| 2018/0160222 | A1 | | 6/2018 | Koo | |

FOREIGN PATENT DOCUMENTS

| | | | |
|---|---|---|---|
| CN | 203675292 | U | 6/2014 |
| CN | 104602158 | A | 5/2015 |
| CN | 109714688 | A | 5/2019 |

* cited by examiner

LOUDSPEAKER SYSTEM

CROSS REFERENCE TO RELATED APPLICATION(S)

This application claims priority to Chinese Patent Application No. CN201910121296.5 filed with the Chinese Patent Office on Feb. 19, 2019, the disclosure of which is incorporated herein by reference in its entirety.

TECHNICAL FIELD

The present disclosure relates to loudspeaker field, and particularly to a loudspeaker system.

BACKGROUND

Traditional loudspeaker systems, such as a loudspeaker system for reducing distortion and changing characteristic curve disclosed in Chinese Patent No. CN104661163B, comprises a panel, a woofer, a tweeter, a midrange loudspeaker, a bass resonance cavity, a tweeter shield and a mid-pitch resonance cavity, wherein the woofer is fixed at a lower portion of the panel in a manner of penetrating through front and back; the tweeter is fixed in the middle of the panel in a manner of penetrating through front and back, the midrange loudspeaker is fixed on the upper portion of the panel in a manner of penetrating through the front and the back; the bass resonance chamber is a cylindrical cavity with an opened front end and a close rear end; the front opened end of the bass resonance cavity and the lower portion of a rear face of the panel are in sealing fixation, and the axis of the bass resonance cavity is coincided with the axis of the woofer. Wherein, the mounted loudspeakers are independent, the low-frequency response is limited by the volume of the box, the efficiency is not high, and a power amplifier providing more power to improve the sound pressure level of the system is needed.

SUMMARY

Aiming at least one of the above problems, the present disclosure provides a loudspeaker system, which can have a good low-frequency response without a large box and can effectively improves the efficiency of the loudspeaker system, so as to increase the output sound pressure level of the system.

To achieve the above purpose, the technical solution employed by the present disclosure is: a loudspeaker system, comprises a box and a plurality of loudspeakers arranged in the box and connected in parallel with each other, wherein each of the loudspeakers comprises a frame, a diaphragm arranged on the frame, and a voice coil for driving a vibration of the diaphragm; front surfaces of the diaphragms of the loudspeakers are arranged to face each other; a sound cavity is formed among the front surfaces of the diaphragms, and the sound cavity is in communication with the outside of the box; and each of the frames is located between a rear surface of its corresponding diaphragm and an inner wall of the box.

In one embodiment, each of the loudspeakers further comprises a capacitor, and the capacitor and the voice coil are connected in series.

In one embodiment, the capacitor is located between its corresponding frame and the inner wall of the box.

In one embodiment, the capacitor and the voice coil are connected in series via a wire.

In one embodiment, the sound cavity is in communication with the outside of the box through a waveguide tube.

In one embodiment, the loudspeaker system further comprises a bracket fixedly arranged within the box, each of the loudspeakers is mounted on the bracket, and the waveguide tube is fixedly connected to the bracket or integrally formed with the bracket.

In one embodiment, the frame of each of the loudspeaker is fixedly connected to the bracket, and the sound cavity is formed between the front surface of the diaphragm and the bracket.

In one embodiment, the bracket is fixedly connected to the inner wall of the box via screws.

In one embodiment, one side of the sound cavity is in communication with the outside of the box through one waveguide tube.

In one embodiment, at least two of the loudspeakers are arranged mirror-symmetrically.

In a specific and preferred embodiment, the loudspeaker system comprises two loudspeakers connected in parallel, positive poles of the two loudspeakers are connected to each other, negative poles of the two loudspeakers are connected to each other, the voice coil of each of the loudspeakers is connected to a capacitor in series, the two loudspeakers are arranged mirror-symmetrically, front surfaces of the diaphragms of the two loudspeakers are arranged to face each other, and the sound cavity is located between the front surfaces of the two diaphragms.

In a specific and preferred embodiment, the loudspeaker system further comprises a bracket fixedly arranged within the box, each of the loudspeakers is mounted on the bracket, the sound cavity is surrounded by the bracket, an upper portion of the bracket is formed with a waveguide tube thereon, and the waveguide tube is in communication with the sound cavity so as to be in communication with the outside of the box.

Specifically, the loudspeaker is a woofer.

Due to the use of the solutions, the present disclosure has the following advantages over the prior art: by mounting a plurality of loudspeakers in a specific parallel structure, the efficiency of the loudspeaker system is increased, and the low-frequency output of the loudspeaker system is improved, which can has a good low-frequency response without a large box and can effectively improves the efficiency of the loudspeaker system, so as to increases the output sound pressure level of the system.

BRIEF DESCRIPTION OF THE DRAWINGS

For more clearly explaining the technical solutions in the embodiments of the present disclosure, the accompanying drawings used to describe the embodiments are simply introduced in the following. Apparently, the below described drawings merely show a part of the embodiments of the present disclosure, and those skilled in the art can obtain other drawings according to the accompanying drawings without creative work.

Wherein,

1—box; 2—loudspeaker; 21—frame; 22—diaphragm; 23—voice coil; 24—capacitor; 3—sound cavity; 4—waveguide; 41—wall; 5—inner cavity; 6—bracket.

DETAILED DESCRIPTION

In the following, the preferable embodiments of the present disclosure are explained in detail combining with the accompanying drawings so that the advantages and features of the present disclosure can be easily understood by the skilled persons in the art. It should be noted that the explanation on these implementations is to help understanding of the present disclosure, and is not intended to limit the present disclosure.

Figure 1:
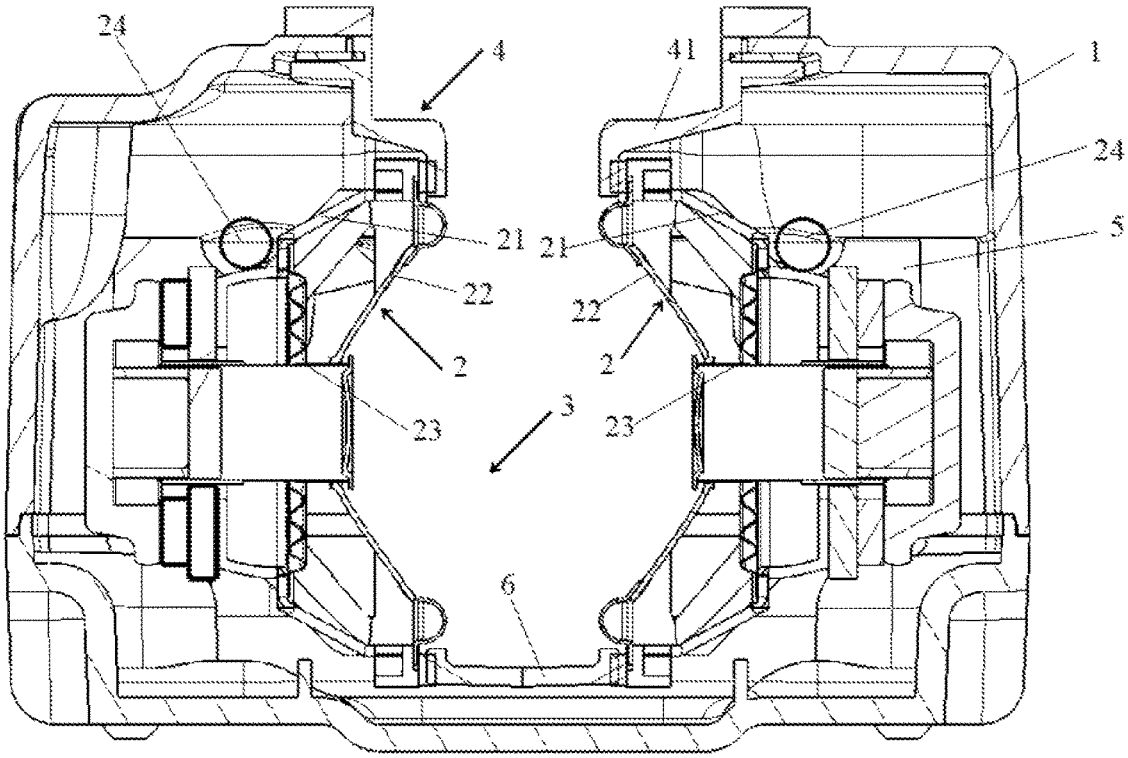
FIG. 1 is a schematic structure diagram of a loudspeaker system according to an embodiment of the present disclosure.
Figure 2:
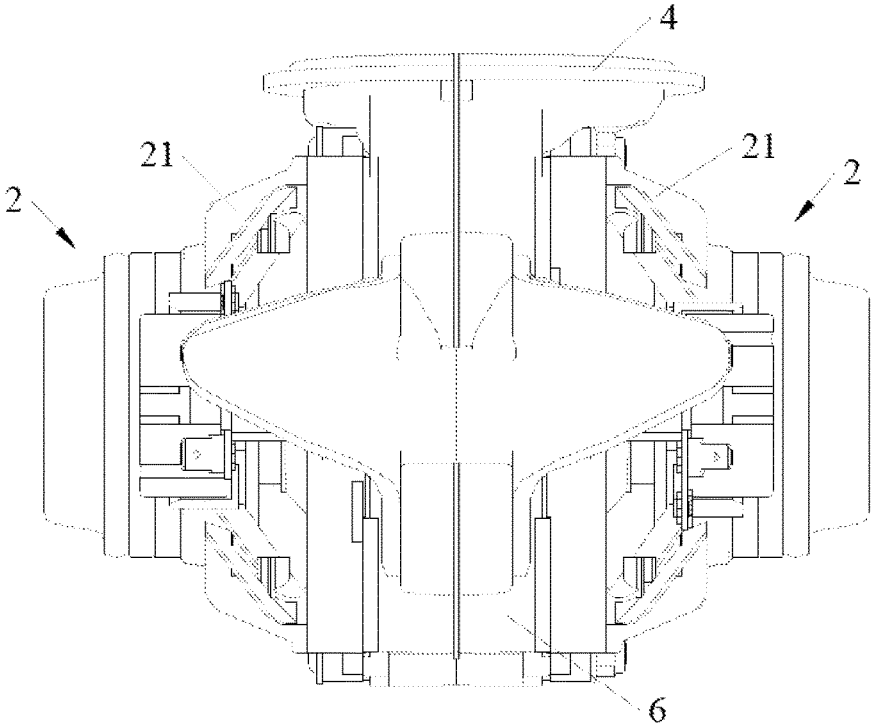
FIG. 2 is a front view of a loudspeaker system according to an embodiment of the present disclosure, wherein the box is not shown.
Figure 3:
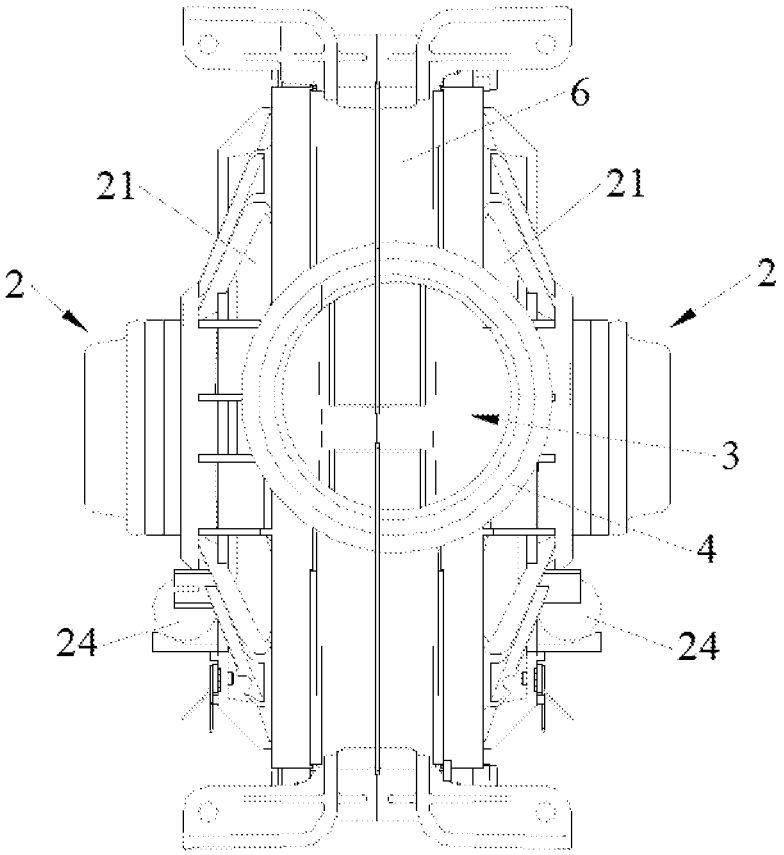
FIG. 3 is a top view of a loudspeaker system according to an embodiment of the present disclosure, wherein the box is not shown.

Referring to FIG. 1 to FIG. 3, this embodiment provides a loudspeaker system, specifically a loudspeaker system with a push-push structure. The loudspeaker system comprises a box 1 and a plurality of woofers 2 arranged in the box 1 and connected in parallel with each other, and at least two of the woofers 2 are arranged mirror-symmetrically. Each of the woofers 2 comprises a frame 21, a diaphragm 22 arranged on the frame 21, and a voice coil 23 for driving the vibration of the diaphragm 22, front surfaces of the diaphragms 22 of the respective woofers 2 are arranged to face each other, and a sound cavity 3 is formed between the respective diaphragms 22, the sound cavity 3 is in communication with the outside of the box 1 and each of the frames 21 is located between a rear surface of its corresponding diaphragm 22 and an inner wall of the box 1. Each of the woofers 2 further comprises a capacitor 24, and the capacitor 24 and the voice coil 23 are connected in series via a wire. In the present disclosure, "the front surface of the diaphragm" refers to the side surface of the diaphragm that is farther from the frame and the magnetic circuit system, and "the rear surface of the diaphragm" refers to the side surface that faces the frame and the magnetic circuit system and is closer to the frame and the magnetic circuit system.

Specifically, as shown in FIG. 1, the loudspeaker system in this embodiment comprises two woofers 2 connected in parallel, that is, positive poles of the two woofers 2 are connected to each other, negative poles of the two woofers 2 are connected to each other, and the voice coil 23 of each of the woofers 2 is connected to a capacitor 24 in series. The two woofers 2 are arranged mirror-symmetrically, front surfaces of the diaphragms 22 of the two woofers 2 are arranged to face each other, and the sound cavity 3 is located between the front surfaces of the two diaphragms 22.

The loudspeaker system comprises a bracket 6 fixedly arranged within the box 1. Specifically, referring to FIG. 2, the bracket 6 is fixedly connected to the inner wall of the box 1 via screws. Each of the two woofers 2 is respectively mounted on the bracket 6, the outer edge of the frame 21 is fixedly connected to the bracket 6, and the sound cavity 3 is surrounded by the bracket 6. A waveguide tube 4 is formed by an upper portion of the bracket 6, and the waveguide tube 4 is in communication with the sound cavity 3 so as to be in communication with the outside of the box 1. That is to say, the sound cavity 3 is in communication with the outside world through the waveguide tube 4, so that the sound in the sound cavity 3 can be output. In addition, only one side of the sound cavity 3 is in communication with the outside of the box 1 through one waveguide tube 4, that is, the sound is output only from one waveguide tube 4. The box 1 is provided with an opening for mounting the waveguide tube 4, and the other parts are basically sealed, one end portion of the wall 41 of the waveguide tube 4 is fixedly connected to the opening of the box 1, and the other end portion is fixedly connected to the frame 21 of each of the woofers 2. The capacitor 24 is specifically located between the rear surface of its corresponding frame 21 and the inner wall of the box.

Figure 4:
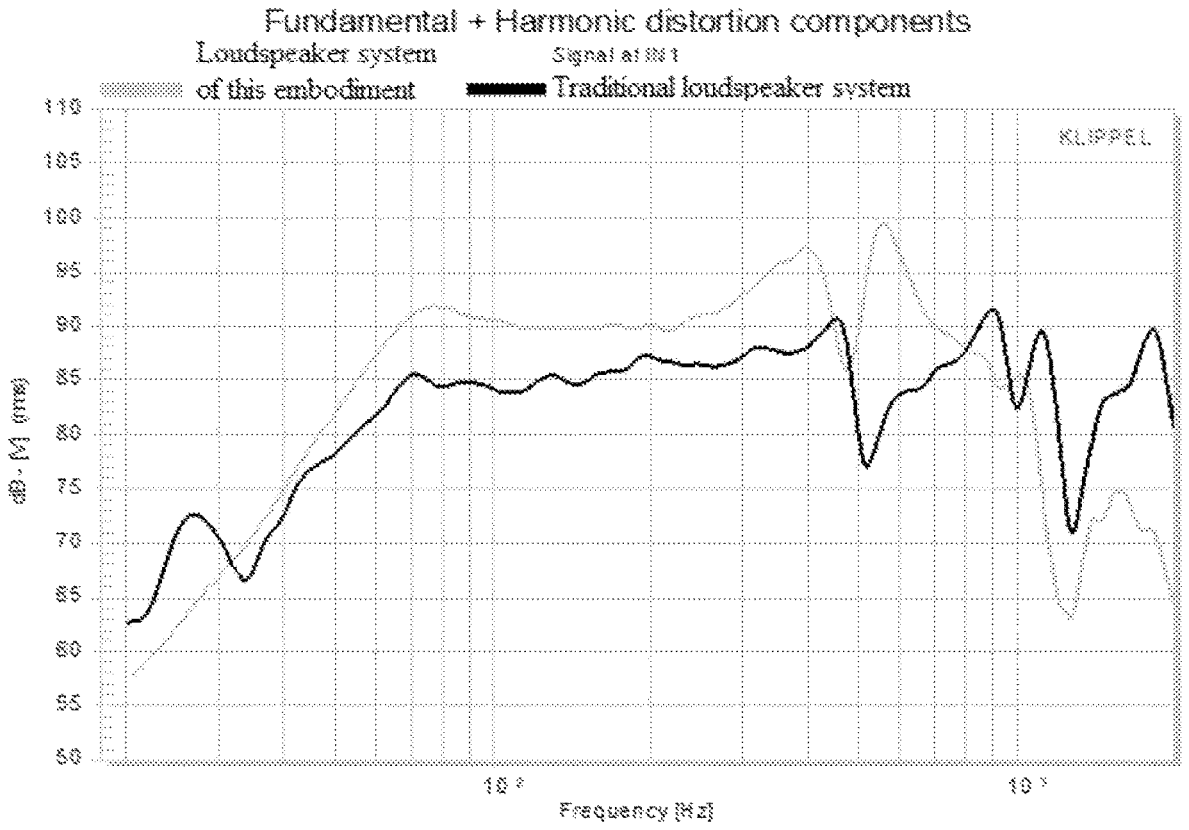
FIG. 4 illustrates a comparison between the frequency responses of a loudspeaker system according to an embodiment of the present disclosure and a conventional loudspeaker.

Referring to FIG. 4, frequency response tests and comparison were performed on the loudspeaker system shown in FIG. 1 of this embodiment and a traditional loudspeaker system (including two mutually independent loudspeakers), wherein, the light-colored frequency response curve is the frequency response curve of the loudspeaker system shown in FIG. 1 of this embodiment, and the dark-colored frequency response curve is the frequency response curve of the traditional loudspeaker system. It can be seen from FIG. 4 that the low frequency response curve of the loudspeaker system shown in FIG. 1 of this embodiment is higher than that of the traditional loudspeaker system.

In the present disclosure, the voice coil 23 of each of the woofers 2 is respectively connected in series with the capacitor 24, and then the plurality of woofers 2 after connecting the capacitors 24 in series are connected in parallel, and output through the waveguide tube 4, which increases the efficiency of the woofer system, and improves the low-frequency output of the woofer system, can has a good low-frequency response without a large box 1 and can effectively improves the efficiency of the loudspeaker system, so as to increases the output sound pressure level of the woofer system.

The embodiments described above are only for illustrating the technical concepts and features of the present disclosure, are preferred embodiments, and are intended to make those skilled in the art being able to understand the present disclosure and thereby implement it, and should not be concluded to limit the protective scope of this disclosure.

We claim:

1. A loudspeaker system, comprising a box and a plurality of loudspeakers arranged in the box and connected in parallel with each other, wherein each of the loudspeakers comprises a frame, a diaphragm arranged on the frame, and a voice coil for driving a vibration of the diaphragm, front surfaces of the diaphragms of the loudspeakers are arranged to face each other, a sound cavity is formed among the front surfaces of the diaphragms, and the sound cavity is in communication with the outside of the box, and each of the frames is located between a rear surface of its corresponding diaphragm and an inner wall of the box, wherein the sound cavity is in communication with the outside of the box through a waveguide tube;

the loudspeaker system further comprises a bracket fixedly arranged within the box, each of the loudspeakers is mounted on the bracket, and the waveguide tube is fixedly connected to the bracket or integrally formed with the bracket.

2. The loudspeaker system according to claim 1, wherein each of the loudspeakers further comprises a capacitor, and the capacitor and the voice coil are connected in series.

3. The loudspeaker system according to claim 2, wherein the capacitor is located between its corresponding frame and the inner wall of the box.

4. The loudspeaker system according to claim 2, wherein the capacitor and the voice coil are connected in series via a wire.

5. The loudspeaker system according to claim 1, wherein the frame of each of the loudspeaker is fixedly connected to the bracket, and the sound cavity is formed between the from surface of the diaphragm and the bracket.

6. The loudspeaker system according to claim 1, wherein the bracket is fixedly connected to the inner wall of the box via screws.

7. The loudspeaker system according to claim 1, wherein one side of the sound cavity is in communication with the outside of the box through one said waveguide tube.

8. The loudspeaker system according to claim 1, wherein at least two of the loudspeakers are arranged mirror-symmetrically.

9. The loudspeaker system according to claim 1, wherein the loudspeaker system comprises two loudspeakers connected in parallel, positive poles of the two loudspeakers are connected to each other, negative poles of the two loudspeakers are connected to each other, the voice coil of each of the loudspeakers is connected to a capacitor in series, the two loudspeakers are arranged mirror-symmetrically, front surfaces of the diaphragms of the two loudspeakers are arranged to face each other, and the sound cavity is located between the front surfaces of the two diaphragms.

10. The loudspeaker system according to claim 1, wherein the sound cavity is surrounded by the bracket, an upper portion of the bracket is formed with the waveguide tube thereon, and the waveguide tube is in communication with the sound cavity so as to be in communication with the outside of the box.

11. The loudspeaker system according to claim 1, wherein the loudspeaker is a woofer.

* * * * *